US008356894B2

(12) United States Patent
Endo et al.

(10) Patent No.: US 8,356,894 B2
(45) Date of Patent: Jan. 22, 2013

(54) RECORDING APPARATUS AND LIQUID EJECTING APPARATUS

(75) Inventors: Tsunenobu Endo, Matsumoto (JP); Kazuma Ozaki, Okaya (JP); Tsuyoshi Otani, Chino (JP); Atsushi Sumii, Shiojiri (JP); Yasuharu Harada, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 663 days.

(21) Appl. No.: 12/249,102

(22) Filed: Oct. 10, 2008

(65) Prior Publication Data

US 2009/0115827 A1 May 7, 2009

(30) Foreign Application Priority Data

Oct. 16, 2007 (JP) ..... 2007-269562
Oct. 29, 2007 (JP) ..... 2007-281008
Oct. 6, 2008 (JP) ..... 2008-260018

(51) Int. Cl.
*B41J 2/01* (2006.01)

(52) U.S. Cl. ..... 347/102

(58) Field of Classification Search ..... 347/49, 347/102, 40–43, 51, 52, 93, 97, 101
See application file for complete search history.

(56) References Cited

U.S. PATENT DOCUMENTS 6,742,866 B2 * 6/2004 Anderson et al. ..... 347/40
6,786,589 B2 * 9/2004 Suzuki et al. ..... 347/102
6,877,853 B2 * 4/2005 Kiguchi et al. ..... 347/102
6,910,764 B2 * 6/2005 Nakajima ..... 347/102
7,152,969 B2 * 12/2006 Hintermann ..... 347/102
7,387,682 B2 * 6/2008 Miura et al. ..... 118/669
7,837,319 B2 * 11/2010 Rodin et al. ..... 347/102

FOREIGN PATENT DOCUMENTS

| | | | |
|---|---|---|---|
| JP | 60-132767 | | 7/1985 |
| JP | 06-198162 | | 7/1994 |
| JP | 10-073784 | | 3/1998 |
| JP | 2002-292207 | | 10/2002 |
| JP | 2003-011343 | | 1/2003 |
| JP | 2004-181941 | | 7/2004 |
| JP | 2004284141 | A * | 10/2004 |
| JP | 2005-342970 | A | 12/2005 |
| JP | 2007-261205 | A | 10/2007 |

* cited by examiner

*Primary Examiner* — Hai C Pham

(74) *Attorney, Agent, or Firm* — Workman Nydegger

(57) ABSTRACT

An ink jet recording apparatus includes a recording head which discharges ultraviolet curing inks toward a recording sheet while reciprocally moving in a reciprocal movement direction M crossing a transportation direction S of the recording sheet; and an ultraviolet irradiation head which irradiates ultraviolet rays toward the ultraviolet curing inks discharged from the recording head and attached to the recorded medium. The recording head includes a going recording head and a returning recording head which are disposed at the front and the back of the reciprocal movement direction M with respect to a region in which the ultraviolet irradiation head irradiates the ultraviolet rays to the recording sheet.

11 Claims, 7 Drawing Sheets

RECORDING APPARATUS AND LIQUID EJECTING APPARATUS

CROSS REFERENCES TO RELATED APPLICATIONS

The present invention contains subject matter related to Japanese Patent Application No. 2007-281008 filed in the Japanese Patent Office on Oct. 29, 2007, Japanese Patent Application No. 2007-269562 filed in the Japanese Patent Office on Oct. 16, 2007, and Japanese Patent Application No. 2008-260018 filed in the Japanese Patent Office on Oct. 6, 2008, the entire contents of which are incorporated herein by reference.

BACKGROUND

The present invention relates to a recording apparatus and a liquid ejecting apparatus, and more particularly, to a recording apparatus for forming an image using an ultraviolet curing ink and a liquid ejecting apparatus for forming a pattern using a liquid containing ultraviolet curing resin.

RELATED ART

There is a recording apparatus and a liquid ejecting apparatus for forming an image on a recorded medium using an ultraviolet curing ink. The ultraviolet curing ink has preferable characteristics as a print ink in that curing is very slow before ultraviolet rays are irradiated and curing is rapid when ultraviolet rays are irradiated. Since a solvent is not volatilized and radiated in the curing process, an environmental load is small.

Since the ultraviolet curing ink has a high adhesion property by the composition of a proper vehicle, a resin film or a metal foil may be used as a recording medium. By forming an underlying layer or a background layer using an ink having high opacifying properties, it is possible to form a clear image on a recorded medium having a transparent or deep color. In addition, by coating the surface with the ink of the background color or a transparent color after an image is formed by color inks, the surface is smoothened and the image can be protected. As a method of adhering the ultraviolet curing ink to the recorded medium, coating or printing may be used, but an ink jet method which is capable of forming an image or pattern with high precision without a print plate is expected to be used.

In Patent Document 1, an ink jet printer using an ultraviolet curing ink is disclosed. In this ink jet printer, an ultraviolet lamp adjacent to an ink jet head is mounted in a carrier (carriage) and ultraviolet rays are irradiated on the ultraviolet curing ink immediately after being adhered to a recorded medium. Since the ultraviolet lamp is disposed adjacent to the ink jet head in a transportation direction of the recorded medium, the ultraviolet rays are irradiated to a corresponding region after the ink jet head scans the width of the recorded medium.

In Patent Document 2, a recording apparatus having a structure in which a pair of ultraviolet lamps with an ink jet head interposed therebetween along a scan direction of a carriage is mounted in the carriage together with the ink jet head is disclosed. In Patent Document 3, a recording apparatus including ultraviolet irradiation units with a recording head interposed therebetween in a scan direction is disclosed.

In these recording apparatuses, the ultraviolet rays are irradiated to the ultraviolet curing ink immediately after the ink is discharged from the recording head. Since the pair of ultraviolet irradiation units are disposed with the recording head interposed therebetween in the scan direction, the ultraviolet rays can be irradiated to the ultraviolet curing ink immediately after the ink is discharged from the recording head even in any one of a going path and a returning path of the scan.

SUMMARY OF THE INVENTION

As an ultraviolet light source of the ultraviolet irradiation unit, a discharge tube type ultraviolet lamp such as a metal halide lamp, a xenon lamp, a carbon arc lamp, a chemical lamp, a low pressure mercury lamp or a high pressure mercury lamp may be used. Since this type of light source includes a quartz glass tube for sealing a discharge atmosphere and a large-sized insulating member for maintaining a high voltage at the time of lighting, it is difficult to realize downsizing. If a plurality of ultraviolet irradiation units is provided in a recording head, the size of the recording apparatus is significantly increased.

If a LED is used as an ultraviolet light emitting unit, a plurality of devices is mounted in order to realize a desired output. Accordingly, it is difficult to downsize the ultraviolet irradiation unit like the discharge tube type lamp.

A high-output ultraviolet lamp which can rapidly cure an ultraviolet curing ink is expensive. Even in the case of using the LED, cost is increased compared with the discharge tube type ultraviolet lamp due to the increase of the number of devices. Accordingly, if the plurality of ultraviolet irradiation units is provided, it is difficult to avoid the increase in the cost of the recording apparatus.

In order to solve the problems, according to a first aspect of the invention, there is provided a recording apparatus including: a recording head which discharges ultraviolet curing inks toward a recorded medium while reciprocally moving in a direction crossing a transportation direction of the recorded medium; and an ultraviolet irradiation head which irradiates ultraviolet rays toward the ultraviolet curing inks discharged from the recording head and attached to the recorded medium, wherein the recording head includes a going recording head and a returning recording head which are disposed at the front and the back of a reciprocal movement direction of the recording head with respect to a region in which the ultraviolet irradiation head irradiates the ultraviolet rays to the recorded medium. Accordingly, it is possible to downsize the recording apparatus by reducing the number of ultraviolet irradiation heads having a large size. In addition, since the dimension and the mass of the reciprocally moving member can be reduced, it is possible to suppress vibration and noise due to an operation.

In the recording apparatus, each of the going recording head and the returning recording head may include a plurality of nozzles which are arranged along the transportation direction and discharge inks, and the nozzles of the going recording head may be arranged at positions different from the nozzles of the returning recording head in the transportation direction. Accordingly, the ultraviolet curing ink discharged by the going recording head and the ultraviolet curing ink discharged by the returning recording head are impacted on the surface of the recorded medium at different positions. Therefore, it is possible to prevent the ultraviolet curing inks before curing from being mixed with each other such that an image blurs.

In the recording apparatus, the going recording head and the returning recording head may be offset to each other in the transportation direction by an offset amount smaller than the pitch of the nozzles. Accordingly, the ultraviolet curing ink discharged by the going recording head and the ultraviolet curing ink discharged by the returning recording head are impacted on the surface of the recorded medium at different positions. Therefore, it is possible to prevent the ultraviolet curing inks before curing from being mixed with each other such that an image blurs.

In the recording apparatus, the ultraviolet irradiation head may include an ultraviolet light source and an optical system which forms an optical path for guiding the ultraviolet rays generated by the ultraviolet light source to the surface of the recorded medium. Accordingly, it is possible to decrease the gap between the going recording head and the returning recording head. In addition, since the dimension and the mass of the reciprocally moving member can be reduced in the recording apparatus, it is possible to suppress vibration and noise due to an operation.

The recording apparatus may further include a vibration portion which vibrates at least a portion of the ultraviolet irradiation head. That is, since the curing rate of the ultraviolet curing inks is changed according to the intensity of the ultraviolet rays irradiated, it is preferable that the irradiation intensity is uniform in the irradiation range of the ultraviolet irradiation head used for the purpose of curing the ultraviolet curing inks. Accordingly, if the intensity of the ultraviolet rays irradiated by the ultraviolet irradiation head is uneven, the intensity unevenness can become uniform by vibrating the ultraviolet irradiation head.

According to a second aspect of the invention, there is provided a liquid ejecting apparatus including: a liquid ejecting head which ejects a liquid including ultraviolet curing resin toward an ejected medium while reciprocally moving in a direction crossing a transportation direction of the ejected medium; and an ultraviolet irradiation head which irradiates ultraviolet rays toward the liquid ejected from the liquid ejecting head and attached to the ejected medium, wherein the liquid ejecting head includes a going liquid ejecting head and a returning liquid ejecting head which are disposed at the front and the back of a reciprocal movement direction of the liquid ejecting head with respect to a region in which the ultraviolet irradiation head irradiates the ultraviolet rays to the ejected medium. Accordingly, the above-described effects can be obtained by the liquid ejecting apparatus.

The summary of the invention does not describe all the features of the invention. The invention may include a sub-combination of the features.

The best mode for carrying out the invention will be described.

Hereinafter, the embodiments of the invention will be described. However, the invention related to claims is not limited to the following embodiments. All combinations of the features described in the embodiments are not necessary for the solving means of the invention.

DETAILED DESCRIPTION OF THE DRAWINGS

Figure 1:
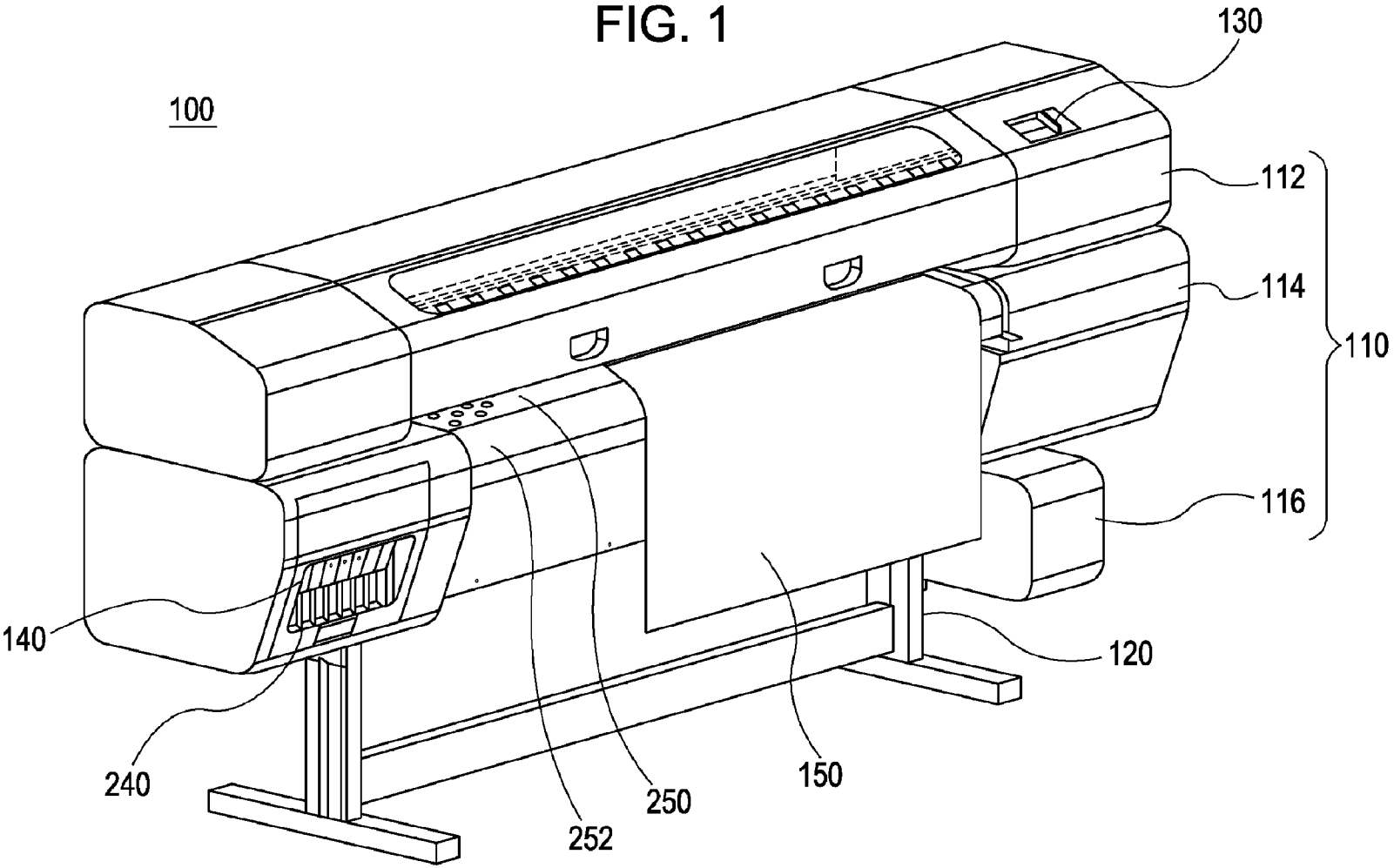
FIG. 1 is a perspective view showing the appearance of an ink jet recording apparatus 100 when viewed from a front side thereof.

FIG. 1 is a perspective view showing the appearance of an ink jet recording apparatus 100 according to an embodiment of the invention. The ink jet recording apparatus 100 performs recording by discharging an ink to, for example, a single sheet of large paper called an AO sheet of the JIS standard and a BO sheet of the JIS standard or roll paper having the same sheet width as the single sheet. As a recorded medium, a resin film or the like may be used in addition to paper.

As shown in the same drawing, the ink jet recording apparatus 100 includes a casing body 110 including an upper casing body 112 and a lower casing body 114 which are laminated, and a small-sized casing body 116 suspended from the lower casing body 114 downward. The casing body 110 is lifted and supported by leg portions 120 from the lower side. Accordingly, a space for ejecting a used recording sheet 150 is formed below the casing body 110.

In the upper casing body 112, an operation panel 130 which is used when the ink jet recording apparatus 100 is operated in a stand-alone state is provided. In the operation panel 130, a display panel and a display lamp for displaying an operation state of the ink jet recording apparatus 100 may be provided. In the lower casing body 114, a cartridge holder 140 in which an ink cartridge 240 for receiving an ink is mounted is provided.

In this ink jet recording apparatus 100, the recording sheet 150 on which an image is recorded is fed forward between the upper casing body 112 and the lower casing body 114. The fed recording sheet 150 is hung down by gravity. Accordingly, a smooth guide surface 252 for smoothly guiding the recording sheet 150 is formed on a front end of a suction platen 250 which is viewed via the gap between the upper casing body 112 and the lower casing body 114.

Figure 2:
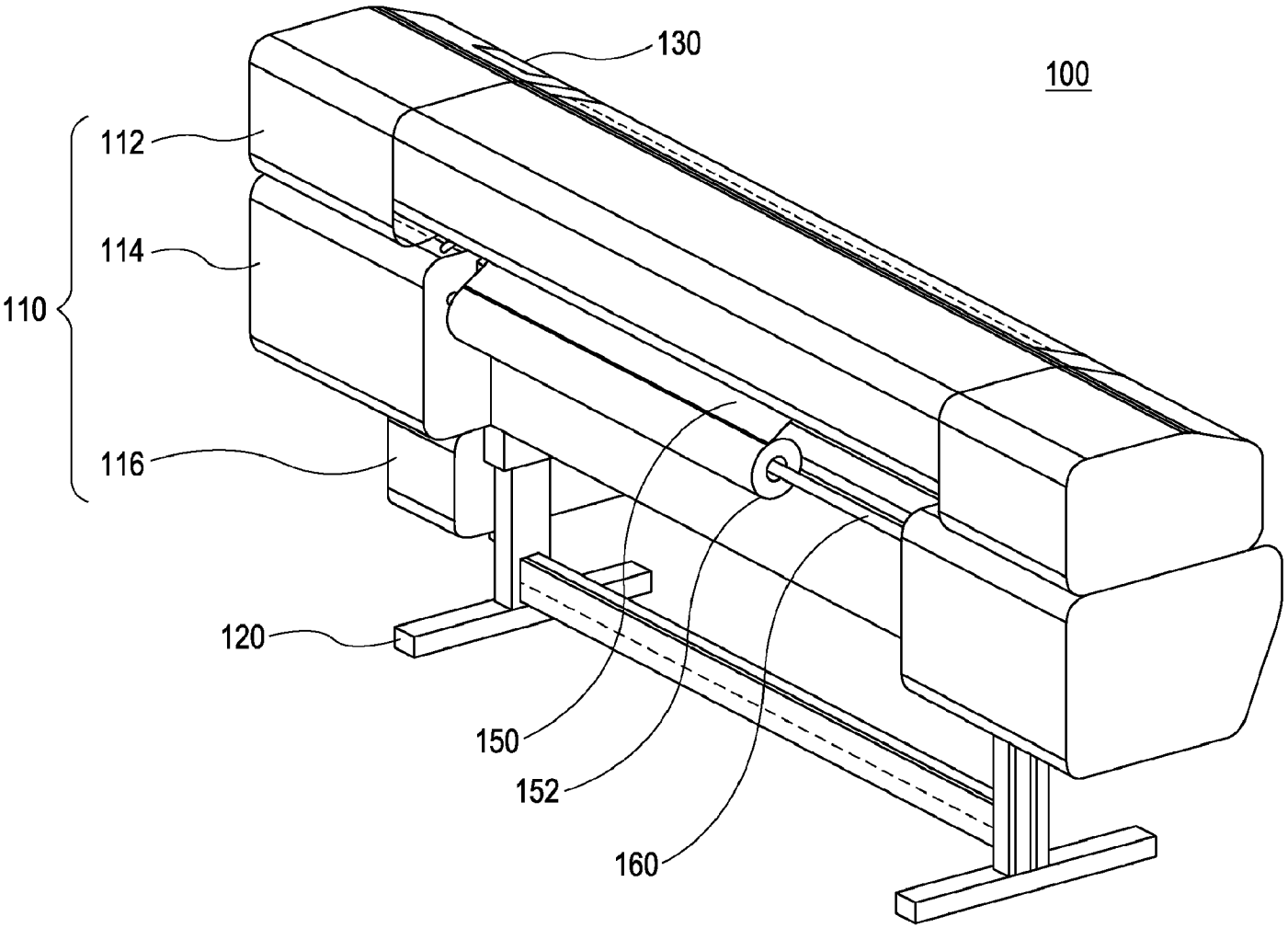
FIG. 2 is a perspective view showing the appearance of the ink jet recording apparatus 100 when viewed from a back side thereof.

FIG. 2 is a perspective view showing the appearance of the ink jet recording apparatus 100 when viewed from a back side thereof. As shown in the same drawing, a spindle 160 horizontally stretched on the back portion of the lower casing body 114 and a roll 152 which is inserted into the spindle 160 and is horizontally supported are mounted on the back surface of the ink jet recording apparatus 100. The roll 152 is formed by winding the elongate recording sheet 150. The recording sheet 150 shown in FIG. 1 corresponds to the front end of the recording sheet 150 which is drawn from the roll 152 to the front side through the inside of the casing body 110.

Figure 3:
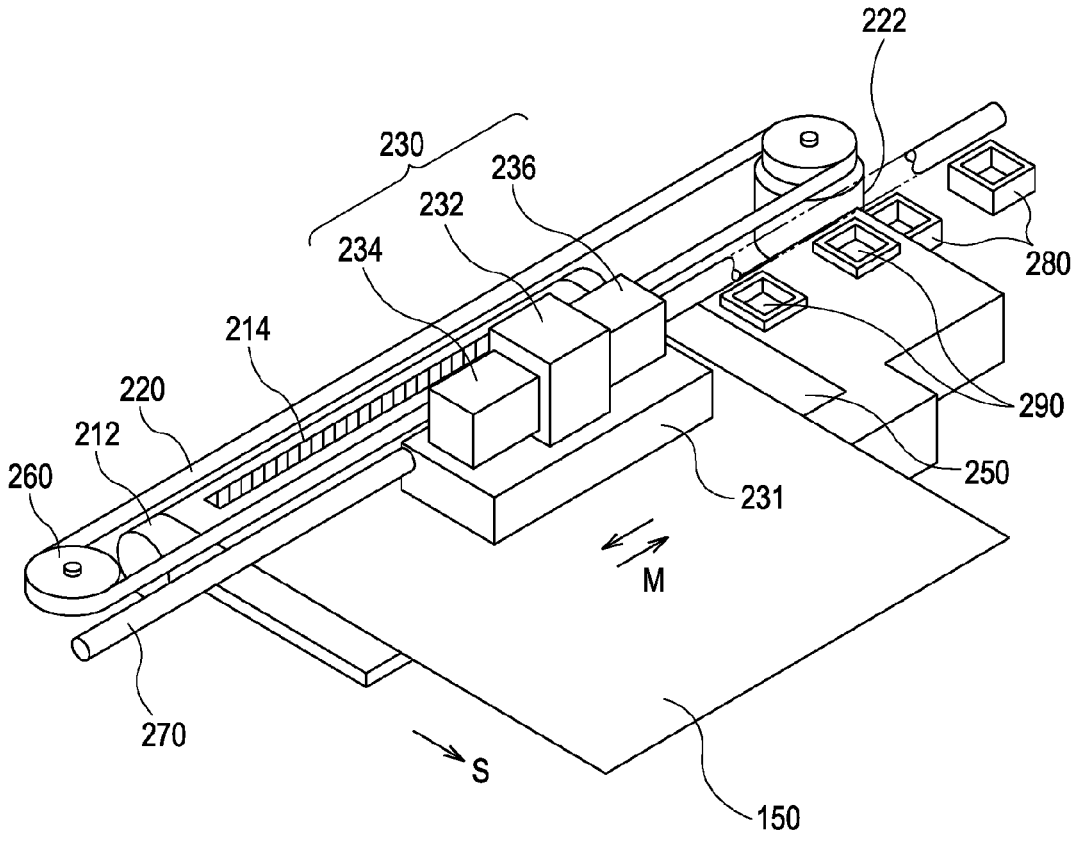
FIG. 3 is a perspective view showing an internal mechanism 200 of the ink jet recording apparatus 100.

FIG. 3 is a perspective view schematically showing an internal mechanism 200 of the ink jet recording apparatus 100. As shown in the same drawing, a guide rail 270 horizontally extending in a longitudinal direction and a carriage 231 which horizontally and reciprocally moves in a reciprocal movement direction M along the guide rail 270 while being supported by the guide rail 270 are disposed in the upper casing body 112. The carriage 231 includes an ultraviolet irradiation head 232, a going recording head 234 and a returning recording head 236 so as to form a recording head assembly 230. In the recording head assembly 230, the going recording head 234 and the returning recording head 236 are disposed with the ultraviolet irradiation head 232 interposed therebetween in the reciprocal movement direction M of the carriage 231.

A transportation portion 210 and the suction platen 250 are sequentially disposed below the guide rail 270 along a transportation direction S of the recording sheet 150. The transportation portion 210 feeds the recording sheet 150 from the back side to the front side. The suction platen 250 supports the recording sheet 150 introduced by the transportation portion 210 from the lower side. The transportation portion 210 is received in the upper casing body 112. The suction platen 250 is received in the lower casing body 114.

The transportation portion 210 includes a transportation driving roller 212 which rotates by a transportation motor. The transportation driving roller 212 rotates while pressing the recording sheet 150 by a transportation driven roller (not shown), draws the recording sheet 150 from the roll 152, and feeds the recording sheet onto the suction platen 250.

The suction platen 250 supports the recording sheet 150 from the lower side on the horizontal flat surface thereof. The suction platen 250 includes a plurality of suction holes which communicates with a depressurization source such as a suction fan and is formed in the surface thereof and sucks the recording sheet 150. Accordingly, the suction platen 250 flatly holds the roll-shaped wound recording sheet 150 below the recording head assembly 230.

A timing belt 220 stretched over a pair of pulleys 260 is disposed on the back side of the guide rail 270. One of the pulleys 260 rotates by a carriage motor 222. The timing belt 220 travels in parallel to the guide rail 270 between the pulleys 260. A portion of the timing belt 220 is coupled to the carriage 231. By this structure, the carriage 231 can move by a driving signal supplied to the carriage motor 222.

A linear scale 214 is disposed in parallel to the reciprocal movement direction M. The linear scale 214 includes a transparent main body and light-shielding bands which are formed in a predetermined period along the reciprocal movement direction M. The carriage 231 provides a detection portion for detecting the light-shielding bands. Accordingly, it is possible to accurately detect the movement amount of the carriage 231.

A flushing portion 290 and a cap 280 are sequentially disposed on the outside of the suction platen 250 in the reciprocal movement direction M of the carriage 231. The flushing portion 290 absorbs the discharged ink when a flushing operation for discharging a large amount of ink from the going recording head 234 and the returning recording head 236 is performed. By such a flushing operation, the thickened ink can be eliminated from the going recording head 234 and the returning recording head 236. The cap 280 air-tightly seals the lower surfaces of the going recording head 234 and the returning recording head 236 in a period of time when the ink jet recording apparatus 100 is idle so as to prevent the ink from being thickened or solidified in the going recording head 234 and the returning recording head 236.

The ink jet recording apparatus 100 having the above-described structure performs the following recording operation. First, the transportation portion 210 transports the recording sheet 150 onto the suction platen 250 and the suction platen 250 flatly holds the transported recording sheet 150. The recording head assembly 230 discharges the ultraviolet curing ink from the going recording head 234 or the returning recording head 236 while reciprocally moving above the recording sheet 150 held on the suction platen 250 and attaches the ink on the recording sheet 150.

In the going path of the recording head assembly 230, the going recording head 234 discharges the ultraviolet curing ink and the ultraviolet irradiation head 232 which following thereto irradiates the ultraviolet rays. In the returning path of the recording head assembly 230, the returning recording head 236 discharges the ultraviolet curing ink and the ultraviolet curing irradiation unit 232 which following thereto irradiates ultraviolet rays.

By individually using the going recording head 234 and the returning recording head 236 disposed at the front and the back of the ultraviolet irradiation head 232 with respect to the reciprocal movement direction M, it is possible to efficiently irradiate the ultraviolet rays using the single ultraviolet irradiation head 232 in the reciprocal movement direction M. The ultraviolet curing ink of the recording sheet 150 onto which the ultraviolet rays are irradiated is cured such that an image is fixed on the recording sheet 150.

Figure 4:
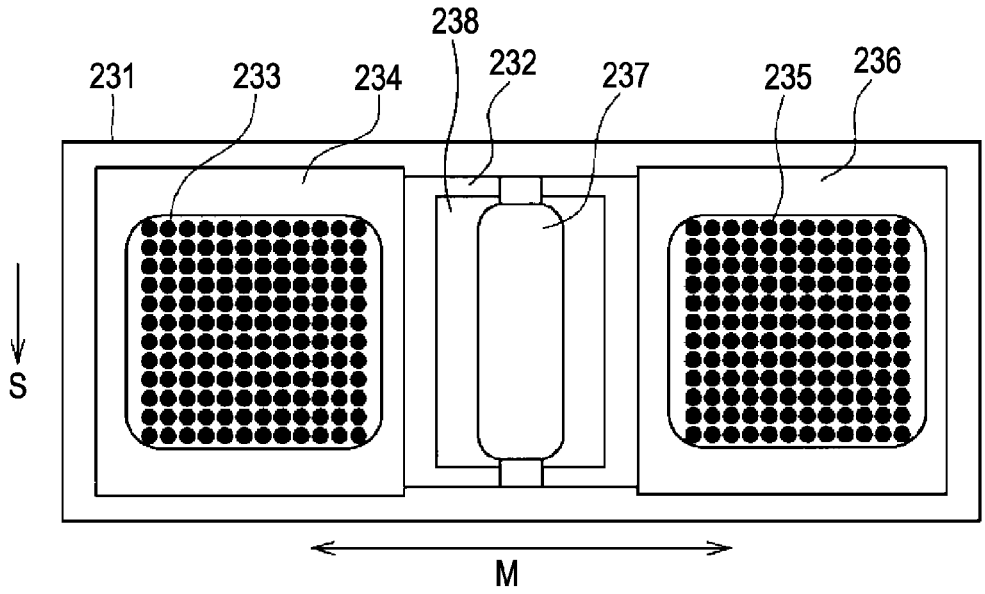
FIG. 4 is a view showing a lower surface of a recording head assembly 230 when viewed from a lower side thereof.

FIG. 4 is a view showing a lower surface of the recording head assembly 230 of the ink jet recording apparatus 100 when viewed from a lower side thereof. As shown in the same drawing, the going recording head 234 includes a plurality of nozzles 233 for discharging the ultraviolet curing ink formed in the lower surface thereof. Similarly, the returning recording head 236 includes a plurality of nozzles 235 for discharging the ultraviolet curing ink formed in the lower surface thereof.

The ultraviolet irradiation head 232 includes a discharge tube 237 for generating the ultraviolet rays in a region interposed between the going recording head 234 and the returning recording head 236 and a reflective mirror 238 having a curved surface for reflecting the ultraviolet rays emitted from the discharge tube 237 and guiding the ultraviolet rays in a specific direction. The discharge tube 237 and the reflective mirror 238 are disposed such that the longitudinal direction thereof is parallel to the transportation direction S and have sizes larger than all the nozzles 233 and 235 arranged in the transportation direction S. Accordingly, it is possible to Irradiate the ultraviolet rays to all the ultraviolet curing inks discharged from the nozzles 233 and 235.

The ultraviolet irradiation head 232, the going recording head 234 and the returning recording head 236 are mounted in the carriage 231 so as to form the recording head assembly 230. The recording head assembly 230 reciprocally moves in the reciprocal movement direction M denoted by an arrow of the drawing along the movement of the carriage 231. With respect to the recording head assembly 230, the recording sheet 150 moves in the transportation direction S denoted by an arrow of the drawing.

The recording head assembly 230 may include a vibration portion (not shown) which vibrates at least a portion of the ultraviolet irradiation head 232, for example, the reflective mirror 238.

The discharge tube 237 receives a voltage applied from a discharge power source and emits the ultraviolet rays. Most of the ultraviolet rays emitted from the discharge tube 237 is reflected from the reflective mirror 238 and is irradiated to the lower side of the drawing. Accordingly, if the reflective mirror 238 vibrates, the irradiation direction of the reflected light is changed.

The discharge tube 237 generates standing stripes or moving stripes according to a discharge path. The both ends of a quartz tube forming the discharge tube are deformed in order to mount a mouthpiece. Accordingly, an intensity distribution occurs in the ultraviolet rays emitted from the discharge tube 237 in the longitudinal direction of the discharge tube 237. However, if the reflective mirror 238 vibrates such that the irradiation direction of the reflected light is changed in the longitudinal direction of the discharge tube 237, the irradiation intensity distribution is spread and the ultraviolet rays having the uniform strength is irradiated onto the recording sheet 150.

The vibration period of the vibration portion is, for example, equal to the frequency of the discharge power source and more particularly to 50 Hz or 60 Hz or more. If the amplitude of the vibration is about several mm and more particularly 4 mm or more in the reflection surface of the reflective mirror 238, the irradiation intensity distribution can sufficiently become uniform.

Figure 5:
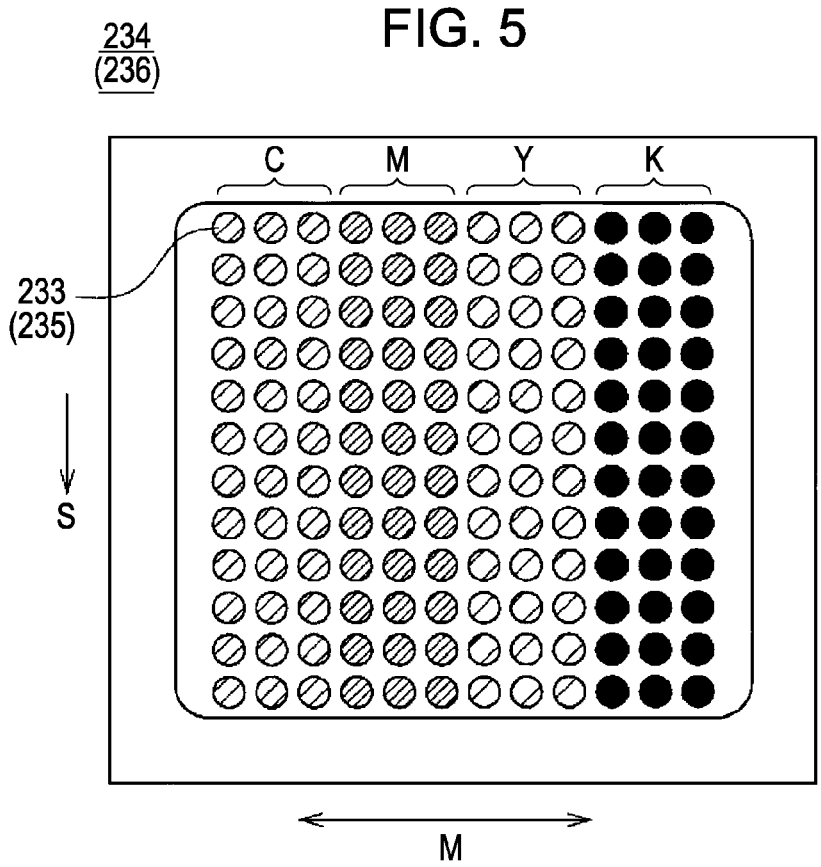
FIG. 5 is a view showing the layout of nozzles 233 and 235.

FIG. 5 is a view showing the layout and the role of the nozzles 233 and 235 of the going recording head 234 and the returning recording head 236. As shown in the same drawing, in the going recording head 234 and the returning recording head 236, the plurality of nozzles 233 and 235 disposed in a matrix form a plurality of nozzle arrays by a series of nozzles 233 and 235 arranged in the transportation direction S.

Each of the nozzle arrays discharges the same type of the ultraviolet curing ink. In this embodiment, respective colors of cyan, magenta, yellow and black are allocated to the same number of nozzle arrays from the left side of the drawing. Accordingly, each of the nozzles 233 and 235 of the going recording head 234 and the returning recording head 236 can form an image including any color.

The number and the combination of the types of the ultraviolet curing inks are not limited to those described above. In some cases, black may not be used in the inks used for forming an image, or inks having different chroma of cyan, magenta and yellow may be additionally combined. Achromatic-color (black) inks having different lightness may be combined. A single-color layer having high opacifying properties may be formed as a background of an image. In addition, a transparent ultraviolet curing ink may be added for the purpose of improving the surface characteristic and protecting the surface of the formed image.

In this recording head assembly 230, the ultraviolet rays are irradiated from the single ultraviolet irradiation head 232 with respect to all the colors, Accordingly, the discharge tube 237 has a light emission wavelength band which is suitable for curing of all types of ultraviolet curing inks discharged from the going recording head 234 and the returning recording head 236.

Figure 6:
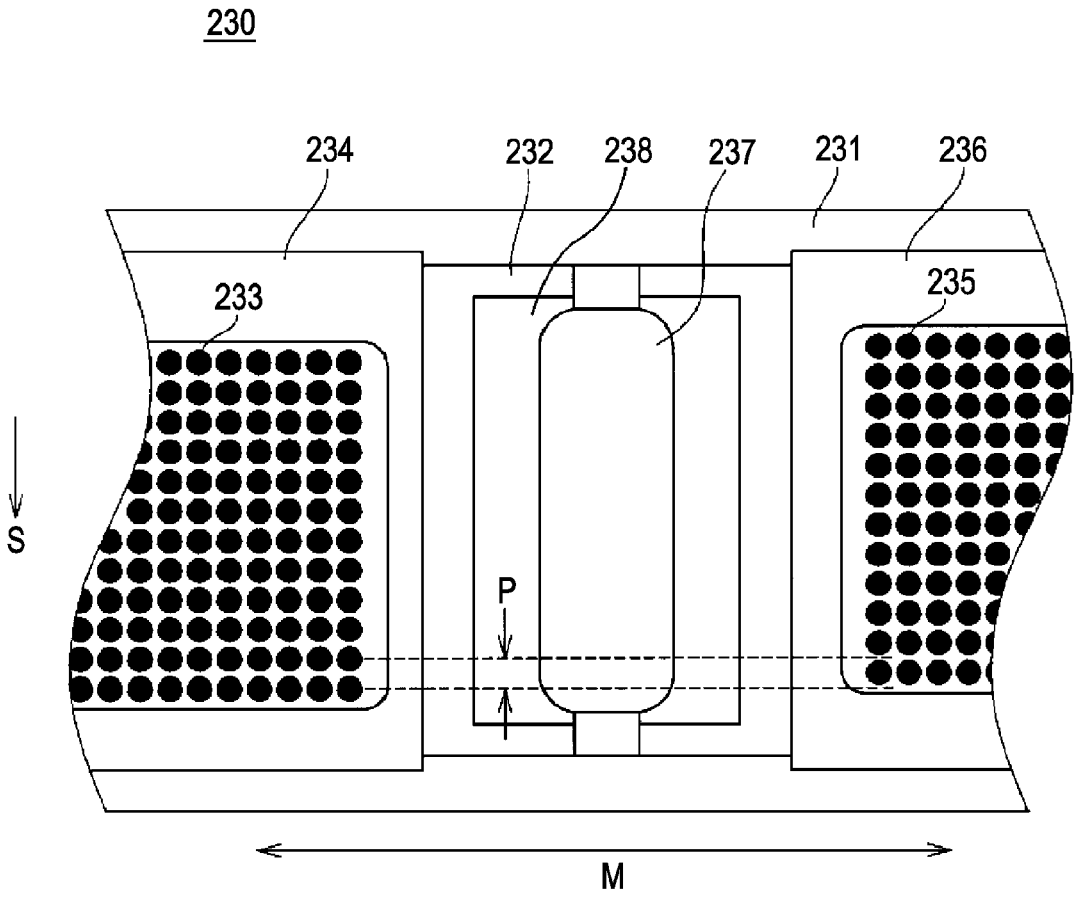
FIG. 6 is an enlarged view of a portion showing the layout of the recording head assembly 230 in detail.

FIG. 6 is an enlarged view of a portion showing the layout of the going recording head 234 and the returning recording head 236 in the recording head assembly 230 shown in FIG. 4 in detail. As shown in the same drawing, the pitches P of the nozzles 233 and 235 of the going recording head 234 and the returning recording head 236 are equal.

The going recording head 234 and the returning recording head 236 are offset with respect to the transportation direction S. The offset amount is smaller than the nozzle pitch P of the going recording head 234 and the returning recording head 236. Accordingly, when the recording head assembly 230 moves in the reciprocal movement direction M, dots which are formed on the recording sheet 150 by the ultraviolet curing ink discharged from the going recording head 234 and dots which are formed on the recording sheet 150 by the ultraviolet curing ink discharged from the returning recording head 236 are different from each other in the position thereof.

Accordingly, the ultraviolet curing ink which is, for example, discharged from the going recording head 234, is attached to the recording sheet 150, and is cured is prevented from being mixed with the ink discharged from the returning recording head 246 in the returning path such that an image blurs. Since the pitch of the dots formed on the recording sheet 150 by the going recording head 234 and the returning recording head 246 is smaller than the nozzle pitch P, the effective resolution of the image is increased.

In the ink jet recording apparatus 100, the volume and the weight of the going recording head 234 and the returning recording head 236 are smaller than those of the ultraviolet irradiation head 232. Accordingly, compared with the case where a plurality of ultraviolet irradiation portions are combined in the single recording head, it is possible to reduce the size and the weight of the recording head assembly 230. Accordingly, it is possible to reduce the scale of the ink jet recording apparatus 100. The vibration and the noise due to the reciprocal movement of the recording head assembly 230 are reduced.

The price of the going recording head 234 and the returning recording head 236 are lower than that of the ultraviolet irradiation head 232. Accordingly, it is possible to reduce manufacturing cost by reducing the number of expensive ultraviolet irradiation heads 232.

Figure 7:
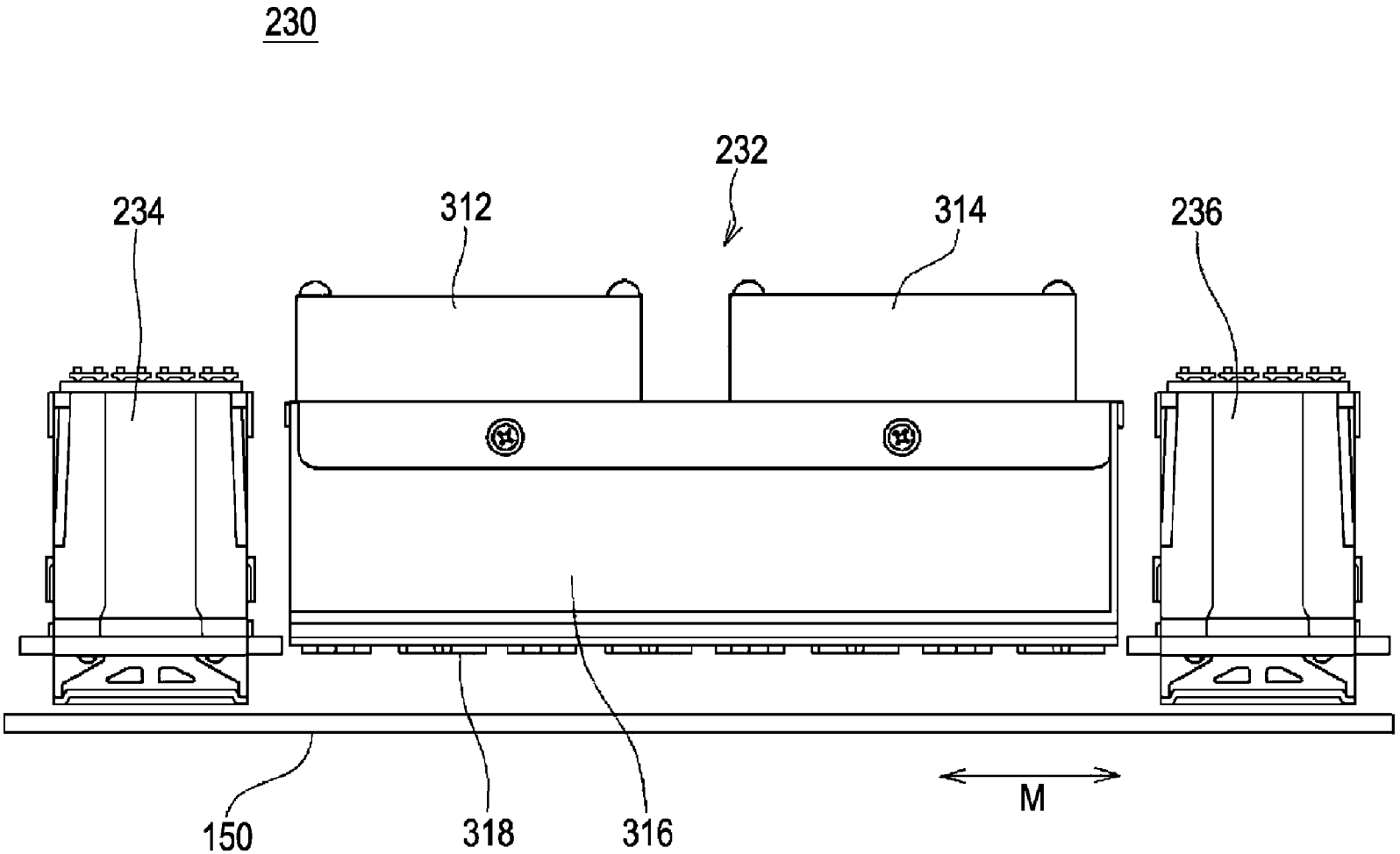
FIG. 7 is a front view showing another embodiment of the recording head assembly 230.

FIG. 7 is a front view showing another embodiment of the recording head assembly 230. As shown in the same drawing, the recording head assembly 230 includes the single ultraviolet irradiation head 232 and the going recording head 234 and the returning recording head 236 with the ultraviolet irradiation head interposed therebetween. The ultraviolet irradiation head 232 includes power source units 312 and 314 for generating driving currents of a plurality of ultraviolet LEDs 318 and ultraviolet LEDs 318 arranged on the lower surface of the casing body 316. The recording head assembly 230 having such a structure can readily form the ultraviolet irradiation head 232 having a required wavelength characteristic by combining the ultraviolet LEDs having various light emission characteristics.

Even in this embodiment, the recording head assembly 230 may include a vibration portion (not shown) for vibrating at least a portion of the ultraviolet irradiation head 232, for example, the ultraviolet LEDs 318 in the reciprocal movement direction M.

The ultraviolet irradiation head 232 may generate unevenness in the irradiation intensity of the ultraviolet rays due to individual difference of the ultraviolet LEDs 318. However, if the ultraviolet irradiation head 232 vibrates, as described above, the unevenness in irradiation intensity is spread and the ultraviolet rays having the uniform intensity are irradiated to the recording sheet 150.

Figure 8:
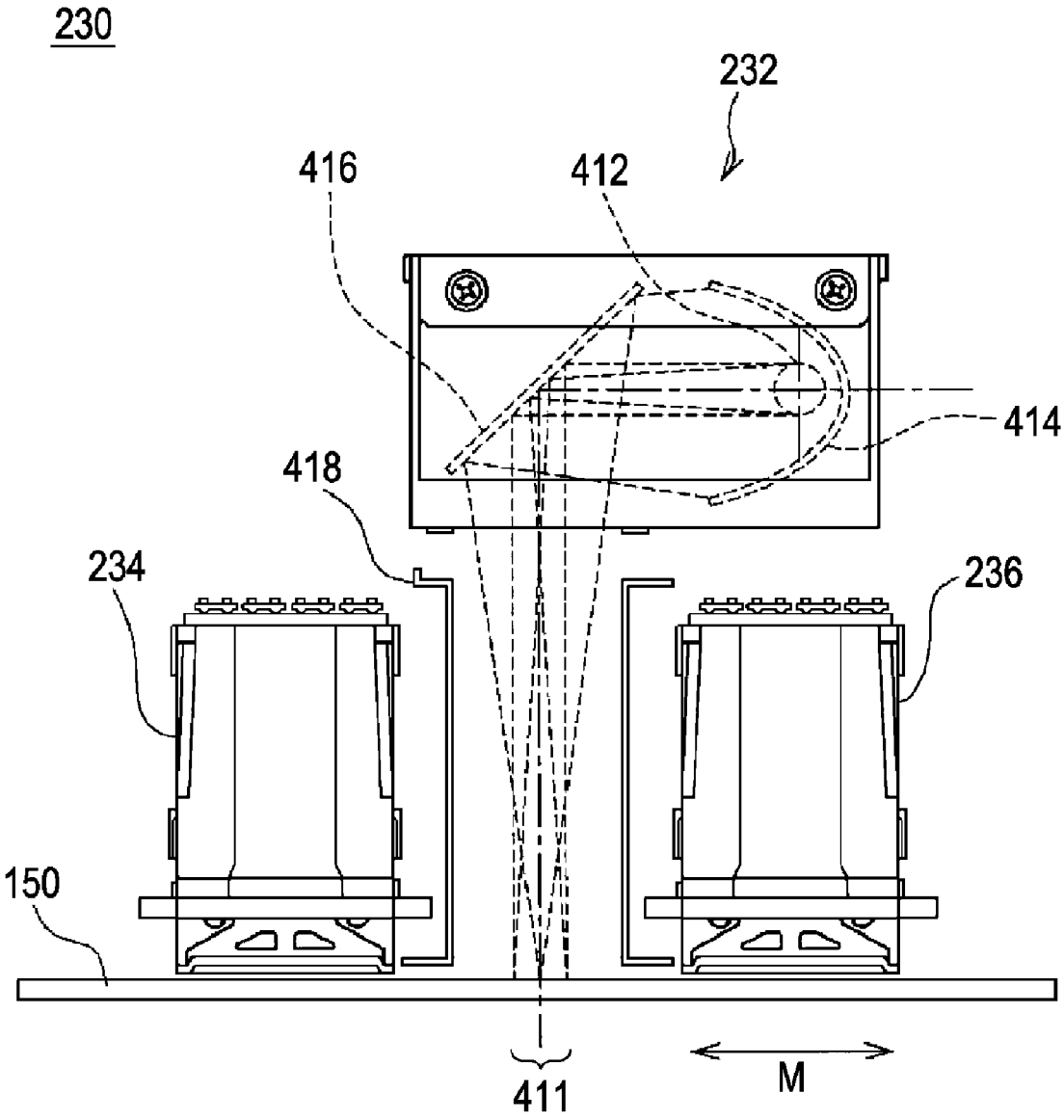
FIG. 8 is a front view showing another embodiment of the recording head assembly 230.

FIG. 8 is a front view showing another embodiment of the recording head assembly 230. As shown in the same drawing, in this recording head assembly 230, the ultraviolet irradiation head 232 is disposed above the going recording head 234 and the returning recording head 236 arranged in the reciprocal movement direction M.

The main body of the ultraviolet irradiation head 232 includes an ultraviolet lamp 412 as an ultraviolet light source, a reflective mirror 414 including a curved surface which reflects the ultraviolet rays emitted from the ultraviolet lamp 412 and guides the ultraviolet rays in a specific direction, and a planar reflective mirror 416 for converting the propagation direction of the light emitted from the reflective mirror 414 downward. The ultraviolet rays emitted from the reflective mirror 416 are propagated between the going recording head 234 and the returning recording head 236 and are irradiated to an irradiation region 411 of the upper surface of the recording sheet 150.

In this structure, since the ultraviolet irradiation head 232 having a large volume may not be disposed, it is possible to reduce the gap between the going recording head 234 and the returning recording head 236. Accordingly, it is possible to reduce a region in which printing cannot be performed near the turning point of the reciprocal movement of the recording head assembly 230. In addition, since the ultraviolet irradiation head 232 can be separated from the going recording head 234 and the returning recording head 236, heat radiation is improved.

If the irradiation region 411 is disposed between the going recording head 234 and the returning recording head 236 instead of the ultraviolet irradiation head 232, desired effects can be obtained. In addition, the ultraviolet rays deteriorate a resin component and a polymer material component or the like. Accordingly, as shown in the drawing, it is preferable that a light-shielding plate 418 formed of metal or the like is provided on facing surfaces of the going recording head 234 and the returning recording head 236 so as to protect the going recording head 234 and the returning recording head 236.

Even in this embodiment, the recording head assembly 230 may include a vibration portion (not shown) for vibrating at least a portion of the ultraviolet irradiation head 232, for example, at least one of the reflective mirror 414 and the reflective mirror 416. If the reflective mirror 238 vibrates such that the irradiation direction of the reflected light is changed in the longitudinal direction of the discharge tube 237, the irradiation intensity distribution is spread and thus the ultraviolet rays having the uniform intensity can be irradiated to the recording sheet 150.

Although the embodiments of the invention are described, the technical range of the invention is not limited to the above-described embodiments. It will be apparent to those skilled in the art that various modifications and improvements may be performed without departing from its spirit and scope. It will be apparent from the description of claims that the modifications and the improvements are included in the technical range of the invention.

The invention claimed is:

1. A recording apparatus comprising:

a recording head which discharges ultraviolet curing inks toward a recorded medium;

an ultraviolet irradiation head which irradiates ultraviolet rays toward the ultraviolet curing inks discharged from the recording head and attached to the recorded medium; and a vibration portion configured to vibrate at least a portion of the ultraviolet irradiation head;

wherein the recording head includes a first recording head and a second recording head.

2. The recording apparatus according to claim 1, wherein:

each of the first recording head and the second recording head includes a plurality of nozzles which are arranged along the transportation direction and discharge inks, and the nozzles of the first recording head are arranged at positions different from the nozzles of the second recording head in the transportation direction.

3. The recording apparatus according to claim 2, wherein the first recording head and the second recording head are offset to each other in the transportation direction by an offset amount smaller than the pitch of the nozzles.

4. The recording apparatus according to claim 1, wherein the ultraviolet irradiation head includes an ultraviolet light source.

5. The recording apparatus according to claim 4, further comprising an optical system that guides the ultraviolet rays generated by the ultraviolet light source to the surface of the medium.

6. The recording apparatus according to claim 5, wherein the ultraviolet light source is arranged above the recording head.

7. The recording apparatus according to claim 1, in a going path of the recording head, the first recording head discharges the ultraviolet curing inks and the ultraviolet irradiation head which is following thereto irradiates the ultraviolet rays, and in a returning path of the recording head, the second recording head discharges the ultraviolet curing inks and the ultraviolet irradiation head which is following thereto irradiates the ultraviolet rays.

8. A liquid ejecting apparatus comprising:

a liquid ejecting head which ejects a liquid including ultraviolet curing resin toward an ejected medium; and an ultraviolet irradiation head which irradiates ultraviolet rays toward the liquid ejected from the liquid ejecting head and attached to the ejected medium;

a vibration portion configured to vibrate at least a portion of the ultraviolet irradiation head to generate a sufficiently uniform irradiation intensity distribution; and wherein the liquid ejecting head includes a first liquid ejecting head and a second liquid ejecting head.

9. The liquid ejecting apparatus according to claim 8, in a going path of the liquid ejecting head, the first liquid ejecting head discharges the liquid including ultraviolet curing resin and the ultraviolet irradiation head which is following thereto irradiates the ultraviolet rays, and in the returning path of the liquid ejecting head, the second liquid ejecting head discharges the liquid including ultraviolet curing resin and the ultraviolet irradiation head which is following thereto irradiates the ultraviolet rays.

10. The recording apparatus of claim 8, wherein the ultraviolet irradiation head including and ultraviolet light source.

11. The recording apparatus of claim 10, wherein the ultraviolet light source is arranged above the recording head or between the first recording head and the second recording head.

* * * * *